US012241632B2

(12) United States Patent
Hansen

(10) Patent No.: US 12,241,632 B2
(45) Date of Patent: Mar. 4, 2025

(54) CONCAVE RECESS FOR FLUSH MOUNT OF A BUILT-IN APPLIANCE

(71) Applicant: Haier US Appliance Solutions, Inc., Wilmington, DE (US)

(72) Inventor: Todd Charles Hansen, Shelbyville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 385 days.

(21) Appl. No.: 17/590,102

(22) Filed: Feb. 1, 2022

(65) Prior Publication Data

US 2023/0243513 A1 Aug. 3, 2023

(51) Int. Cl.
*F24C 15/08* (2006.01)
*F24C 15/30* (2006.01)

(52) U.S. Cl.
CPC ..... *F24C 15/08* (2013.01); *F24C 15/30* (2013.01)

(58) Field of Classification Search
CPC ..... F24C 15/08; F24C 15/30
USPC ..... 312/229
See application file for complete search history.

(56) References Cited

U.S. PATENT DOCUMENTS 4,093,327 A * 6/1978 Linger ..... A47B 95/02 16/443
5,405,672 A * 4/1995 Takiguchi ..... B60R 16/0222 428/161
6,051,790 A * 4/2000 Takeuchi ..... B60R 16/0207 174/72 A
6,479,748 B2 * 11/2002 Mori ..... B60R 16/0222 174/152 G
6,660,984 B1 12/2003 Jeong et al.
6,737,622 B1 * 5/2004 Jeong ..... H05B 6/6429 126/273 A
7,244,894 B1 * 7/2007 Lipp ..... B60R 16/0222 174/152 G
7,345,264 B2 3/2008 Yoshidome
7,494,198 B2 * 2/2009 Wing ..... F16B 12/50 312/265.5
7,499,002 B2 * 3/2009 Blasko ..... G01C 1/00 345/3.1
7,781,684 B2 * 8/2010 Stuckmann ..... H02G 3/088 174/152 G
7,786,391 B1 * 8/2010 Van Pelt ..... H02G 3/18 277/606
8,497,435 B2 * 7/2013 Nagata ..... H02G 15/013 174/152 G
10,777,948 B2 * 9/2020 Thaker ..... H01R 27/02
(Continued)

FOREIGN PATENT DOCUMENTS

CN 211084158 U 7/2020
FR 2817950 A1 6/2002
KR 19990032463 A 5/1999

*Primary Examiner* — Daniel J Troy
*Assistant Examiner* — Timothy M Ayres
(74) *Attorney, Agent, or Firm* — Dority & Manning, P.A.

(57) ABSTRACT

An appliance, such as a built-in kitchen appliance installed within kitchen cabinetry, includes a cabinet having a top wall, a rear wall, a sidewall, and a concave wall, wherein the concave wall defines a cutout volume proximate a corner of the cabinet where the top wall, the rear wall, and the sidewall meet, and a power cord extending through the concave wall for providing electric power to the appliance to facilitate appliance operation.

12 Claims, 4 Drawing Sheets

(56) References Cited

U.S. PATENT DOCUMENTS

| | | | | |
|---|---|---|---|---|
| 11,642,737 | B2 * | 5/2023 | Zwayer | B23K 9/1006 219/130.21 |
| 2008/0236888 | A1 * | 10/2008 | Fujikawa | H02G 11/00 174/659 |
| 2010/0231161 | A1 * | 9/2010 | Brown | H02J 7/0044 320/101 |
| 2021/0172610 | A1 | 6/2021 | Armstrong et al. | |

* cited by examiner

CONCAVE RECESS FOR FLUSH MOUNT OF A BUILT-IN APPLIANCE

FIELD OF THE INVENTION

The present subject matter relates generally to kitchen appliances, and more particularly to built-in kitchen appliances that are installed within cabinetry.

BACKGROUND OF THE INVENTION

Appliances are commonly mounted and/or positioned within confined, space-restricted spaces. For example, residential kitchen appliances are often mounted within cabinetry, below countertops, or in other confined spaces. It is often desirable to have a flush mount installation of such appliances, i.e., where the front face or door of the appliances sits flush or even with a front lip of the countertop, a front edge of the cabinetry, etc. Such an installation provides improved aesthetic appearance, less obstructions within the room, and a better overall flow within the kitchen.

In order to achieve flush mount installations, building codes and/or standards typically call for the mounting of electrical outlets at specific locations within the cabinetry where built-in appliances will be mounted. For example, for a recess within cabinetry that is configured for receiving a microwave oven, the electrical outlet is commonly mounted in the wall proximate a top left side of the microwave. Notably, however, these built-in kitchen appliances utilize a power cord that must be plugged into the outlet and which may protrude slightly from the wall, thereby preventing these built-in appliances from being fully recessed within the cabinet recess to facilitate a flush mount installation. Conventional attempts to accommodate power cords in built-in kitchen appliances include the use of large recesses for storing and supporting power cords. However, these large storage recesses utilize too much of the limited space available within the cabinet recess, thereby resulting in component overheating, reduced cooking cavity sizes, difficult installation or assembly procedures, protruding appliances, etc.

Accordingly, an improved kitchen appliance for cabinet mount applications is desired. More specifically, a built-in kitchen appliance that facilitates flush mount installation and has maximized internal capacity would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, an appliance defining a vertical direction, a lateral direction, and a transverse direction is provided. The appliance includes a cabinet comprising a top wall, a rear wall, a sidewall, and a concave wall, wherein the concave wall defines a cutout volume proximate a corner of the cabinet where the top wall, the rear wall, and the sidewall meet, and a power cord extending through the concave wall for providing electric power to the appliance to facilitate appliance operation.

In another exemplary embodiment, a cabinet for an appliance is provided. The cabinet defines a vertical direction, a lateral direction, and a transverse direction. The cabinet includes a top wall, a rear wall, a sidewall, and a concave wall. The concave wall defines a cutout volume proximate a corner of the cabinet where the top wall, the rear wall, and the sidewall meet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
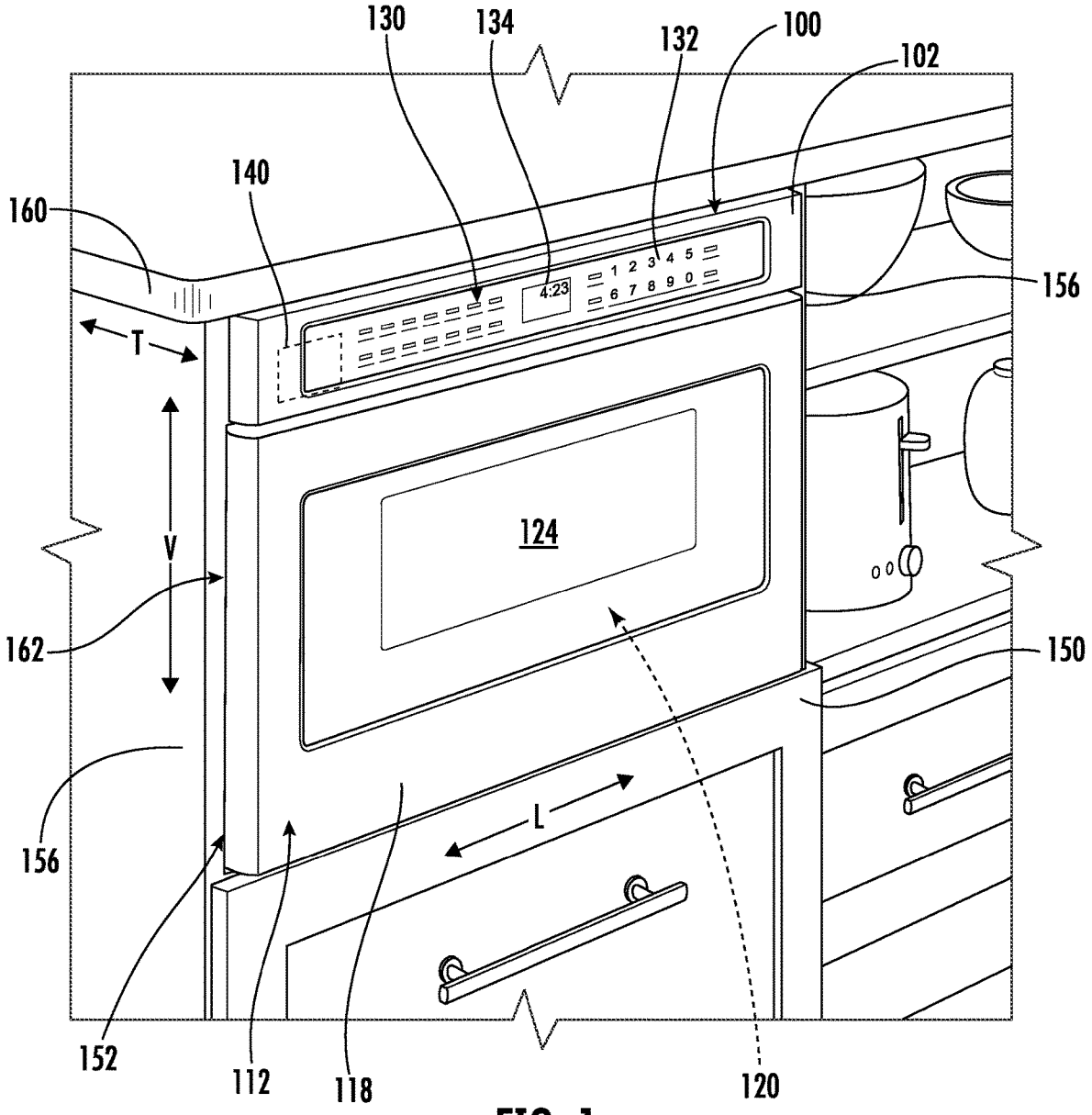
FIG. 1 provides a perspective view of a built-in microwave appliance mounted within kitchen cabinetry according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
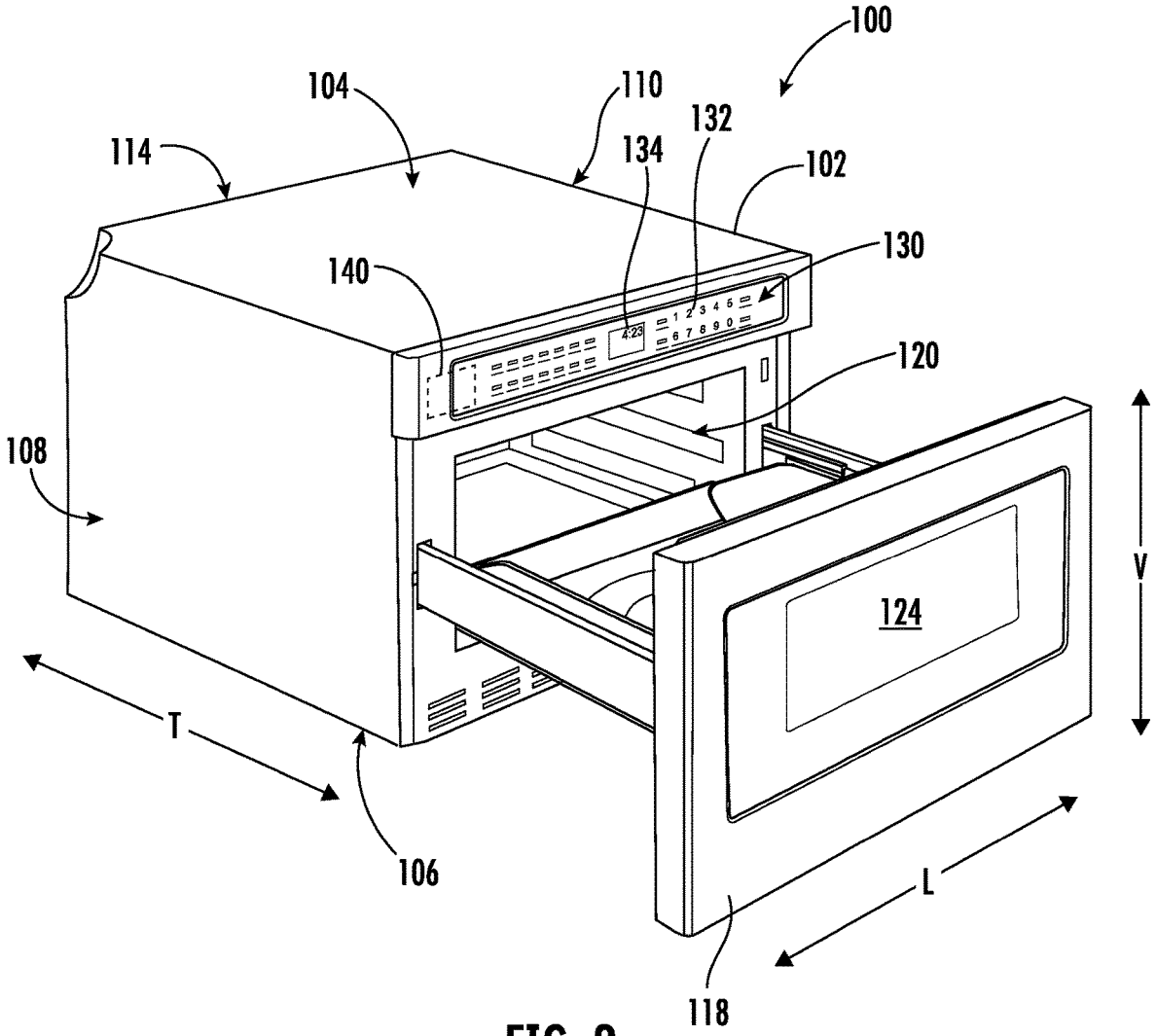
FIG. 2 depicts a perspective view of the exemplary microwave appliance of FIG. 1 with the drawer in an open position according to example embodiments of the present subject matter.

Referring now to the figures, an exemplary appliance will be described in accordance with exemplary aspects of the present subject matter. Specifically, FIG. 1 provides a perspective view of an exemplary microwave oven 100 mounted within kitchen cabinetry and FIG. 2 provides a perspective view of microwave oven 100 removed from the cabinet and with the drawer open. As illustrated, microwave oven 100 generally defines a vertical direction V, a lateral direction L, and a transverse direction T, each of which is mutually perpendicular, such that an orthogonal coordinate system is generally defined.

According to exemplary embodiments, microwave oven 100 includes a cabinet 102 that is generally configured for containing and/or supporting various components of microwave oven 100 and which may also define one or more internal chambers or compartments of microwave oven 100. In this regard, as used herein, the terms "cabinet," "housing," and the like are generally intended to refer to an outer frame or support structure for microwave oven 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of microwave oven 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top wall 104 and a bottom wall 106 along the vertical direction V, between a first side 108 (e.g., the left side when viewed from the front as in FIG. 1) and a second side 110 (e.g., the right side when viewed from the front as in FIG. 1) along the lateral direction L, and between a front 112 and a rear wall 114 along the transverse direction T. In general, terms such as "left," "right," "front," "rear," "top," or "bottom" are used with reference to the perspective of a user accessing microwave oven 100.

As will be understood by those skilled in the art, aspects of the present subject matter are not limited to the illustrated exemplary embodiment. For example, although a microwave oven 100 is used to facilitate discussion of the present subject matter, it should be appreciated that this appliance is provided by way of example only, and the present subject matter may be utilized with any suitable appliance. For example, the present subject matter may be used with wall ovens, refrigerators, dishwashers, other microwave ovens, etc. Thus, the example embodiment shown in the figures is not intended to limit the present subject matter to any particular cooking chamber configuration or arrangement.

According to the illustrated embodiment, microwave oven 100 includes a drawer 118 that is slidably mounted to cabinet 102 in order to permit selective access to cooking chamber 120. A handle may be mounted to drawer 118 to assist a user with opening and closing drawer 118 in order to access cooking chamber 120. As an example, a user can pull on the handle mounted to drawer 118 to open or close drawer 118 and access cooking chamber 120. Alternatively, microwave oven 100 may include a drawer release/open button that disengages or otherwise pushes open drawer 118 when pressed. Glass windowpanes 124 provide for viewing the contents of cooking chamber 120 when drawer 118 is closed and also assist with insulating cooking chamber 120.

Microwave oven 100 is generally configured to heat articles, e.g., food or beverages, within cooking chamber 120 using electromagnetic radiation. Microwave oven 100 may include various components which operate to produce the electromagnetic radiation, as is generally understood. For example, microwave oven 100 may include a microwave heating assembly which may include a magnetron (such as, for example, a cavity magnetron), a high voltage transformer, a high voltage capacitor and a high voltage diode.

The structure and intended function of microwave ovens are generally understood by those of ordinary skill in the art and are not described in further detail herein. According to alternative embodiments, microwave oven may include one or more heating elements, such as electric resistance heating elements, gas burners, other microwave heating elements, halogen heating elements, or suitable combinations thereof, are positioned within cooking chamber 120 for heating cooking chamber 120 and food items positioned therein.

Referring again to FIG. 1, a user interface panel 130 and a user input device 132 may be positioned on an exterior of the cabinet 102. The user interface panel 130 may represent a general purpose Input/Output ("GPIO") device or functional block. In some embodiments, the user interface panel 130 may include or be in operative communication with user input device 132, such as one or more of a variety of digital, analog, electrical, mechanical or electro-mechanical input devices including rotary dials, control knobs, push buttons, and touch pads. The user input device 132 is generally positioned proximate to the user interface panel 130, and in some embodiments, the user input device 132 may be positioned on the user interface panel 130. The user interface panel 130 may include a display component 134, such as a digital or analog display device designed to provide operational feedback to a user.

Generally, microwave oven 100 may include a controller 140 in operative communication with the user input device 132. The user interface panel 130 of the microwave oven 100 may be in communication with the controller 140 via, for example, one or more signal lines or shared communication busses, and signals generated in controller 140 operate microwave oven 100 in response to user input via the user input devices 132. Input/Output ("I/O") signals may be routed between controller 140 and various operational components of microwave oven 100. Operation of microwave oven 100 can be regulated by the controller 140 that is operatively coupled to the user interface panel 130.

Controller 140 is a "processing device" or "controller" and may be embodied as described herein. Controller 140 may include a memory and one or more microprocessors, microcontrollers, application-specific integrated circuits (ASICS), CPUs or the like, such as general or special purpose microprocessors operable to execute programming instructions or micro-control code associated with operation of microwave oven 100, and controller 140 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, a controller 140 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Referring still generally to FIGS. 1 through 5, microwave appliance 100 may generally be configured for mounting within cabinetry (e.g., identified herein generally by reference numeral 150). More specifically, a recess 152 may be defined within the cabinetry 150 that is generally configured for receiving microwave appliance 100 in a manner that facilitates maximum usage of the space within recess 152 while ensuring the flush mount of microwave appliance 100, as described in more detail below. Although an exemplary installation is described herein, it should be appreciated that variations and modifications may be made to microwave appliance 100 and cabinetry 150 while remaining within the scope of the present subject matter.

According to the illustrated embodiment, recess 152 is generally defined by a bottom wall 154 of cabinetry 150, two sidewalls 156 of cabinetry 150, a back wall 158 of cabinetry 150, and a countertop 160 that is seated on top of cabinetry 150 over recess 152. Recess 152 generally defines a front opening 162 through which microwave appliance 100 may slide into recess 152. In addition, as shown schematically for example in FIG. 4, an electrical outlet 164 may generally be defined in back wall 158 of cabinetry 150 at a predetermined position. In this regard, as explained in more detail below, building standards commonly dictate that electrical outlets are positioned at a specific location within the back wall of a microwave recess, e.g., to facilitate universal installation procedures.

As noted above, microwave appliance 100 is generally designed for a flush mount installation within recess 152 of cabinetry 150. Accordingly, according to exemplary embodiments, recess 152 may generally define a recess depth 166 is measured along the transverse direction T from back wall 158 to a front fascia of cabinetry 150. In addition, cabinet 102 may generally define a cabinet depth 168 which is measured along the transverse direction T. According to exemplary embodiments, in order to maximize the usage of recess 152 while ensuring a flush mount installation, cabinet depth 168 is greater and 90% of recess depth 166, greater than 95% of recess depth 166, greater than 98% of recess depth 166, or greater.

Notably, as explained briefly above, when cabinet 102 of microwave appliance 100 utilizes so much space within recess 152, difficulties may arise related to interference with a power cord 170 that is used provide power to microwave appliance 100. Specifically, power cord 170 may be positioned at a desired location within cabinet 102 such that it is adjacent electrical outlet 164 when microwave appliance 100 is installed into recess 152. Power cord 170 may be electrically coupled with controller 140 to provide power to microwave appliance 100 and facilitate appliance operation. Aspects of the present subject matter are directed towards eliminating this power cord interference while maximizing useful space of microwave appliance 100.

Figure 3:
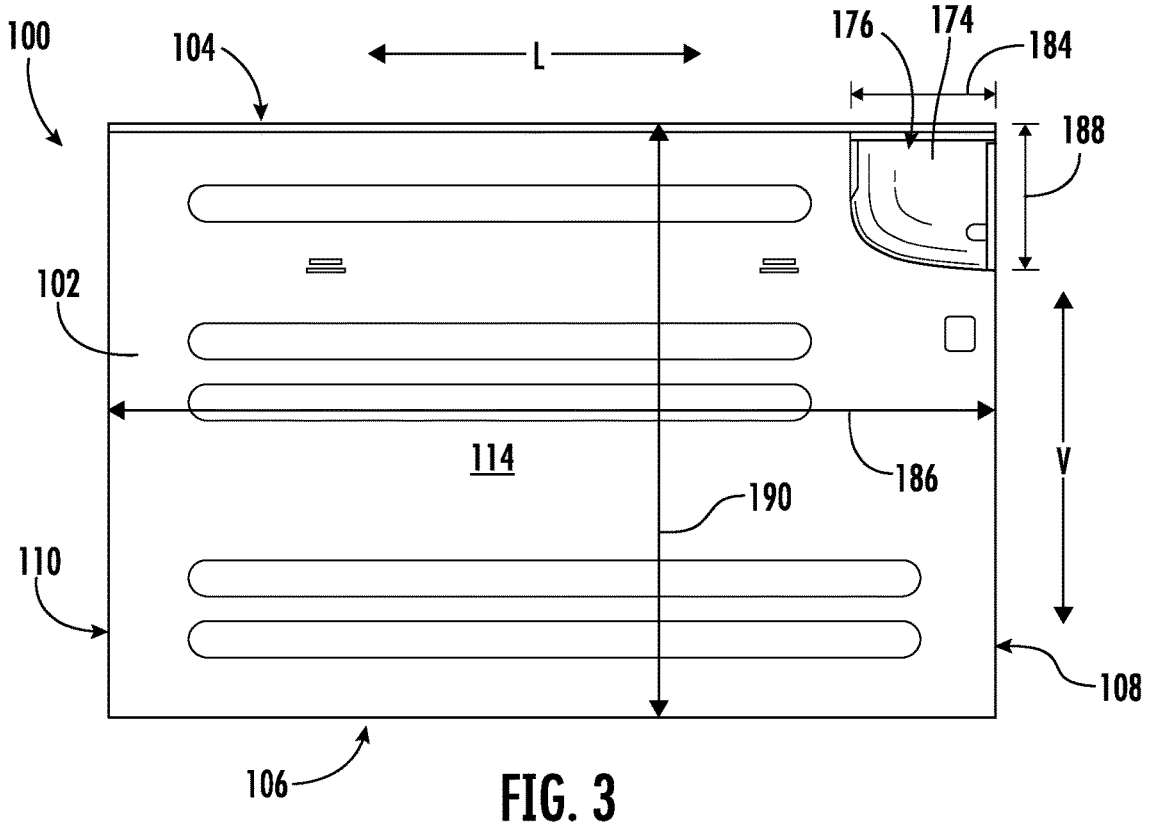
FIG. 3 provides a rear view of the exemplary microwave appliance of FIG. 1 according to example embodiments of the present subject matter.
Figure 4:
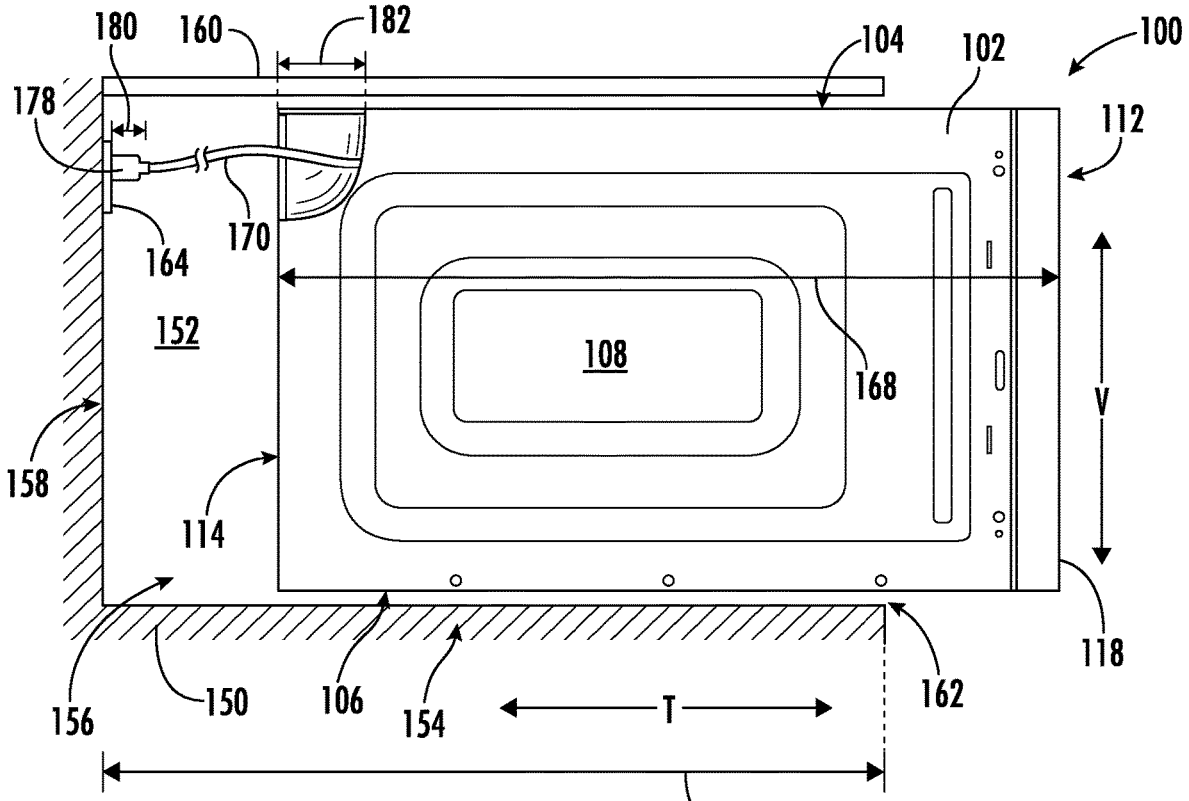
FIG. 4 provides a side view of the exemplary microwave appliance of FIG. 1 according to example embodiments of the present subject matter.
Figure 5:
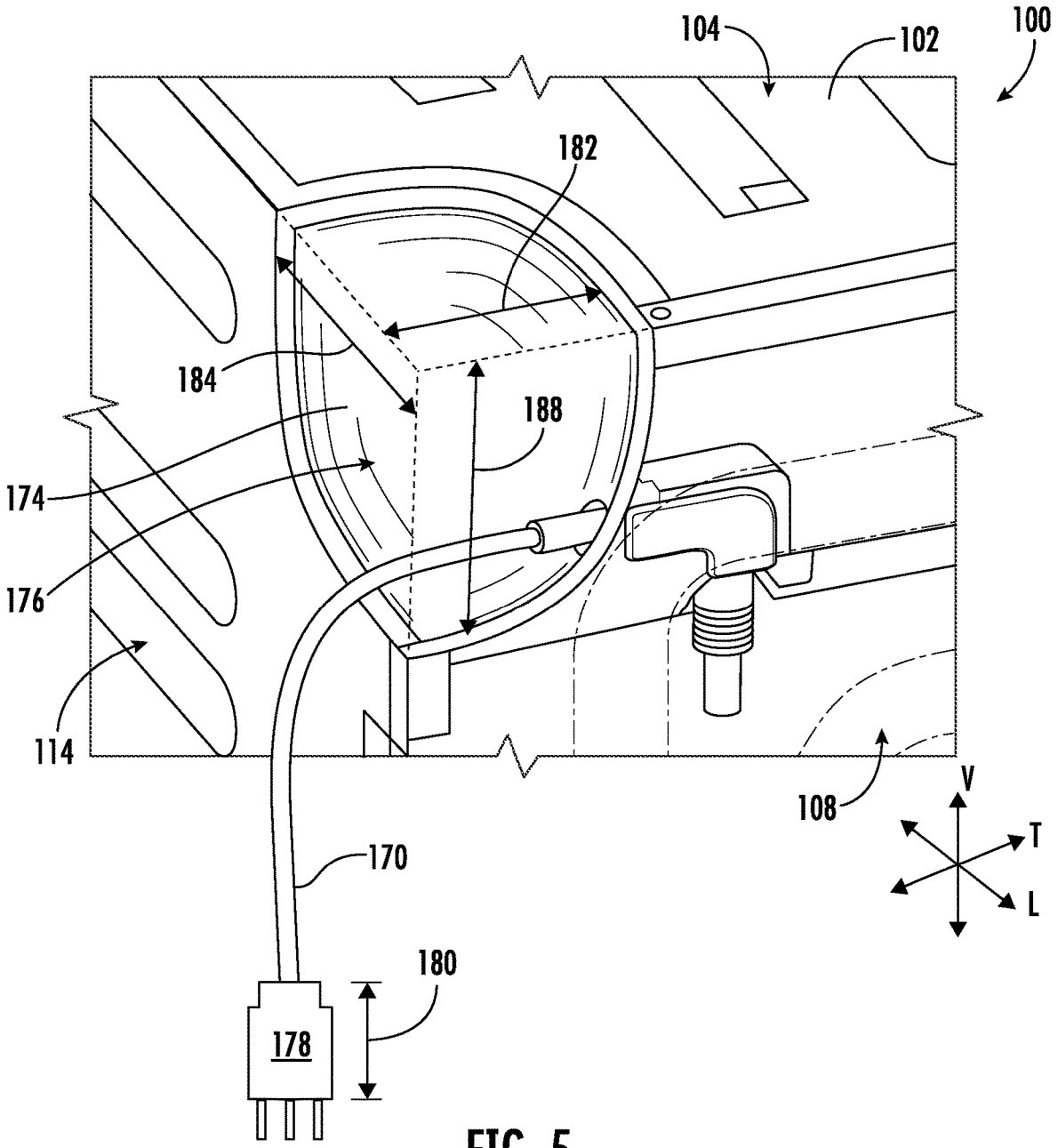
FIG. 5 provides a perspective, rear view of a concave wall defined in a cabinet of the exemplary microwave appliance of FIG. 1 according to example embodiments of the present subject matter.

For example, as best illustrated in FIGS. 3 through 5, cabinet 102 may further include a concave wall 174 that is generally coupled to the top wall 104, rear wall 114, and a sidewall (e.g., first side 108) of cabinet 102. Specifically, concave wall 174 may be positioned at a corner of cabinet 102, e.g., at a top, rear, left of cabinet 102 when viewed from a front of cabinet 102. In general, concave wall 174 defines a cutout volume 176 positioned proximate the corner of cabinet 102, e.g., adjacent electrical outlet 164 when microwave appliance 100 is in an installed position within recess 152. According to the illustrated embodiment, power cord 170 may extend through concave wall 174 for direct electrical coupling with electrical outlet 164 and to provide electric power to microwave appliance 100 to facilitate appliance operation.

In general, concave wall 174 is a curved wall that extends between and joins rear wall 114, top wall 104, and first sidewall 108 of cabinet 102. Concave wall 174 may be constructed from the same materials as the rest of cabinet, e.g., such as metal or another suitably rigid material. In addition, the geometry of concave wall 174 may be designed to minimize space usage of cutout volume 176 while serving other useful purposes. For example, concave wall 174 may be curved throughout and may have no horizontal surfaces. Concave wall 174 may have a constant radius or a varying radius. Other variations are possible and within the scope of the present subject matter.

According to exemplary embodiments, concave wall 174 and cutout volume 176 have been carefully designed to ensure that electrical outlet 164 and power cord 170 do not interfere with the flush mount installation of microwave appliance 100 while the maximum usable space for components within cabinet 102 is maintained. Specifically, cutout volume 176 is generally defined between concave wall 174 and a top plane that contains or coincides with the top wall 104 of cabinet 102, a rear plane that contains or coincides with rear wall 114 of cabinet 102, and a sidewall plane that contains or coincides with a sidewall (e.g., first side 108) of cabinet 102.

In general, cutout volume 176 is sized for or is capable of receiving a connector 178 of power cord 170. In this regard, connector 178 is a plug that may extend from an electrical outlet 164 into cutout volume 176 such that rear wall 114 of cabinet 102 may still sit against back wall 158 of cabinetry 150 for a flush mount installation. More specifically, according to an exemplary embodiment, connector 178 may generally define a connector length 180 that is measured along the transverse direction when power cord 170 is plugged into electrical outlet 164. In addition, cutout volume 176 may find a cutout depth 182 measured along the transverse direction T. According to exemplary embodiments, connector length 180 is greater than 80% of cutout depth 182, greater than 90% of cutout depth 182, greater than 95% of cutout depth 182, or greater. In addition, according to exemplary embodiments, cutout volume 176 may define a cutout width 184 measured along the lateral direction L. According to exemplary embodiments, cutout width 184 is equal to or less than cutout depth 182. According to still other embodiments, cutout width is 50% of cutout depth 182 or smaller.

According to exemplary embodiments, the dimensions of cabinet 102 are designed to fully maximize the space within recess 152. For example, according to exemplary embodiments, cabinet 102 may define a cabinet width 186 measured along the lateral direction L between first side 108 and second side 110. According to exemplary embodiments, cutout width 184 may be less than 20% of cabinet width 186, less than 15% of cabinet width 186, less than 10% of cabinet width 186, less than 5% of cabinet width 186, or less. In addition, cutout volume 176 may generally define a cutout height 188 measured along the vertical direction V. In addition, cabinet 102 may define a cabinet height 190 measured along the vertical direction V. According to exemplary embodiments cutout height 188 is less than 20% of cabinet height 190, less than 15% of cabinet height 190, less than 10% of cabinet height 190, less than 5% of cabinet height 190, or less. In addition, cabinet 102 may define a cabinet depth 168 measured along the transverse direction T. According to exemplary embodiments cutout depth 182 is less than 15% of cabinet depth 168, less than 10% of cabinet depth 168, less than 5% of cabinet depth 168, or less.

As explained above, the size and geometry of cabinet 102 is designed to maximize space that is usable within recess 152. In this regard, cabinet 102 may generally define a cabinet of volume, e.g., including all space interior to and defined by the walls of cabinet 102 and concave wall 174. According to exemplary embodiments, cutout volume 176 less than 10% of the cabinet volume, less than 8% of the cabinet volume, less than 4% of the cabinet volume, or less. It should be appreciated that the design and geometry of microwave appliance 100 and cabinet 102 may vary while remaining within the scope of the present subject matter.

As explained above, aspects of the present subject matter are directed to a built-in kitchen appliance including a concave wall that defines a cutout volume or a radial negative space cutaway that facilitates flush mount installation with the cabinetry while also allowing full utilization of the kitchen cabinet depth. For example, this cutout volume ensures that appliance can maintain the maximum amount of interior volume as usable space in the appliance. In addition, the appliance is still able to plug into an electrical outlet positioned on the back wall or within the kitchen cabinets without interference of the outlet and/or the power cord. By contrast, in conventional designs, the built-in kitchen appliance cannot be installed in flush mount installation application with maximum usable volumetric capacity due to power cord interference. Accordingly, the disclosed appliance may be built into the kitchen cabinetry or walls, providing a seamless, integrated look for modern kitchens. In addition, panel-ready models are customized to blend with the rest of the cabinetry so that the appliances look like another cabinet in the kitchen.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance defining a vertical direction, a lateral direction, and a transverse direction, the appliance comprising:

a cabinet comprising a top wall, a rear wall, a sidewall, and a concave wall, wherein the concave wall defines a cutout volume proximate a corner of the cabinet where the top wall, the rear wall, and the sidewall meet, wherein the concave wall is curved and has no horizontal surfaces; and a power cord extending through a curved portion of the concave wall for providing electric power to the appliance to facilitate appliance operation.

2. The appliance of claim 1, wherein the power cord comprises a connector defining a connector length and the cutout volume defines a cutout depth measured along the transverse direction, and wherein the connector length is greater than 80% of the cutout depth.

3. The appliance of claim 1, wherein the cabinet defines a cabinet width measured along the lateral direction and the cutout volume defines a cutout width measured along the lateral direction, wherein the cutout width is less than 20% of the cabinet width.

4. The appliance of claim 1, wherein the cabinet defines a cabinet height measured along the vertical direction and the cutout volume defines a cutout height measured along the vertical direction, wherein the cutout height is less than 20% of the cabinet height.

5. The appliance of claim 1, wherein the cabinet defines a cabinet depth measured along the transverse direction and the cutout volume defines a cutout depth measured along the transverse direction, wherein the cutout depth is less than 15% of the cabinet depth.

6. The appliance of claim 1, wherein the corner of the cabinet is at a top, rear, left of the cabinet when viewed from a front of the cabinet.

7. The appliance of claim 1, wherein the cutout volume is defined between the concave wall, a top plane containing the top wall, a rear plane containing the rear wall, and a sidewall plane containing the sidewall, wherein the cutout volume is capable of receiving a connector of the power cord.

8. The appliance of claim 7, wherein the cabinet defines a cabinet volume, and wherein the cutout volume is less than 10% of the cabinet volume.

9. The appliance of claim 8, wherein the cutout volume is less than 5% of the cabinet volume.

10. The appliance of claim 1, wherein the cutout volume defines a cutout depth measured along the transverse direction and a cutout width measured along the lateral direction, wherein the cutout width is less than the cutout depth.

11. The appliance of claim 1, wherein the appliance is mounted within a recess in a kitchen cabinet, the recess defining a recess depth measured along the transverse direction from a back wall to a front facia, and wherein a cabinet depth of the cabinet is greater than 95% of the recess depth.

12. The appliance of claim 1, wherein the appliance is a microwave oven or a wall oven.

* * * * *